US005203797A

United States Patent [19]

Petersen

[11] Patent Number: 5,203,797

[45] Date of Patent: Apr. 20, 1993

[54] RAPID JAW ADJUSTMENT FOR TOOLS AND THE LIKE

[75] Inventor: Ralph Petersen, DeWitt, Nebr.

[73] Assignee: Petersen Manufacturing Co., Inc., DeWitt, Nebr.

[21] Appl. No.: 613,945

[22] Filed: Nov. 8, 1990

Related U.S. Application Data

[63] Continuation of Ser. No. 392,707, Aug. 11, 1989, abandoned.

[51] Int. Cl.[5] ..... B25B 7/12

[52] U.S. Cl. ..... 81/367; 81/370; 411/412

[58] Field of Search ..... 81/367, 370, 380; 411/412, 413

[56] References Cited

U.S. PATENT DOCUMENTS 1,489,458 4/1924 Petersen ..... 81/380
3,192,804 7/1965 Petersen et al. ..... 81/370 X
3,942,405 3/1976 Wagner ..... 411/412 X
4,329,099 5/1982 Shimizu et al. ..... 411/412

FOREIGN PATENT DOCUMENTS 1514569 6/1978 United Kingdom .

*Primary Examiner*—James G. Smith
*Attorney, Agent, or Firm*—Lackenbach, Siegel, Marzullo, Aronson & Greenspan

[57] ABSTRACT

A hand tool which comprises a fixed handle with a fixed jaw on the front portion and a movable jaw pivotally connected to the front portion of the fixed handle. A movable handle is connected to the movable jaw. An adjusting mechanism is provided for adjusting the position of the movable jaw relative to the fixed jaw and consists of a threaded opening in the rear of the fixed handle and a screw member received within the opening. The screw member has a plurality of multiple first individual threads with the same diameter and pitch that mate with the threaded opening in the fixed handle.

20 Claims, 4 Drawing Sheets

RAPID JAW ADJUSTMENT FOR TOOLS AND THE LIKE

This application is a continuation of application Ser. No. 392,707, filed Aug. 11, 1989, abandoned.

BACKGROUND OF THE INVENTION

This invention relates to hand tools, and more particularly to tools utilizing a pair of jaws for receiving a workpiece therebetween.

Common elements of locking pliers, locking wrenches and similar tools employing some form of locking toggle-actuation are a pair of stationary and movable jaws adapted to lock a workpiece therebetween. A mechanism with an adjusting element acting on the movable jaw is usually provided to adjust a gap between the jaws and to bring them into possible initial contact with a workpiece before huge forces of the toggle action are generated and applied.

The tools of the type presently described are usually used in the circumstances when fast and efficient adjustment of the gap between the jaws is not only highly desirable but absolutely necessary. One example of such use is a conveyor welding operation where a welder has a very short time for adjustment of the tool between welding together two separate pairs of elements having different dimensions. In this situation, it is extremely important to adjust the gap between the jaws of the locking tool to accommodate the dimensions of a new pair of elements as soon as possible.

A known type of prior art device makes such adjustment of a gap between the jaws by means of rotation of a single threaded, single pitch adjustment screw to which the movable jaw is connected directly or indirectly. This method and means of adjustment are necessarily slow and time consuming and result in loss of valuable time in adjusting the tools from one size to another.

U.S. Pat. No. 2,681,583 recognizes the necessity of fast adjustment of the spacing between adjustable jaws of wrenches. It also recognizes that the conventional means of adjustment are slow and time-consuming, since these methods depend on the speed of rotation of the threaded shafts. This patent specifically teaches that use of the threaded screw member which advances longitudinally while it is rotated within the threaded opening of the tool, is slow, tedious and time-consuming and should be avoided. In view of that, this patent provides a device in which the space between the wrench jaws is adjusted by a straight line reciprocating manipulation of the control rods. When it is desired to bring the jaws from the spread-apart to the locked position, the movable jaw is typically swung manually towards the fixed jaw until the desired spacing is achieved. Thereupon, a control rod is grasped and pushed inwardly and longitudinally to butt against the rear parts of the adjusting means. A pivotally movable arrangement is used to secure the position of the rod and to lock a gap between the jaws.

U.S. Pat. No. 2,643,567 to Johnson provides another hand tool to effect faster adjustment of the gap between the jaws. In this patent, fixedly mounted in the tubular outer end portion of the fixed handle is a bushing having a threaded bore in which is threadedly engaged a tubular adjusting screw having right-hand external threads. The adjusting screw projects rearwardly from the handle member and the projecting portion of the screw has a turning knob. The adjusting screw is formed with internal threads engaged by left-hand threads provided upon a toggle holder.

U.S. Pat. No. 3,590,669 to Maranco discloses a locking hand tool having a higher rate of advancement of the adjusting screw. However, such rate of adjustment is the result of the use of the large lead angle of the thread combined with the large diameter of the screw.

U.S. Pat. No. 4,389,145 to Capuano discloses an internally threaded fastener which includes a body having an opening with a sidewall. Coarse and fine threads are formed in the sidewall of the nut body. The turns of these threads are intermingled to enable them to engage a fastener having either a coarse or fine external thread. Capuano specifically teaches that the terms "coarse" and "fine" are used in the patent to distinguish between thread convolutions having a greater and lesser number of turns per unit of axle length.

SUMMARY OF THE INVENTION

The present invention provides a hand tool which comprises a fixed handle with front and rear portions. A fixed jaw is connected to the front portion and a receiving part being located at the rear portion. A movable jaw is pivotally connected to the front portion of the fixed handle for cooperation with the fixed jaw, and a movable handle is connected to the movable jaw.

An adjusting mechanism is provided for adjusting the position of the movable relative to the stationary jaw. This adjusting mechanism consists of a threaded opening positioned within the receiving part of the fixed handle, and a screw member having a first end adapted for hand rotation thereof. The screw member has a plurality of multiple first individual threads with the same diameter and pitch throughout the entire length thereof.

The threaded opening with a plurality of multiple permanent second individual threads has the same diameter and pitch throughout the entire length thereof.

The plurality of first and second individual threads is adapted to engage with said plurality of first threads of the screw member.

In the locking hand tool a substantially increased rate of advancement of the screw member in the axial direction results from rotational engagement of the plurality of first threads of the screw member with the plurality of second threads of the threaded opening, and from the action of the adjusting mechanism and the toggle member acting on the movable handle and movable jaw. All this produces a substantial increase in the rate of adjustment of the movable jaw relative to the stationary jaw.

Another embodiment of the invention discloses a locking hand tool having a fixed handle with front and rear portions. A fixed jaw is connected to the front portion and a receiving part being located at the rear portion. A movable jaw is pivotally connected to the front portion of the fixed handle for cooperation with the fixed jaw, and a movable handle is connected to the movable jaw.

A toggle arrangement defined by at least one toggle member has first and second ends in which the first end of the toggle member being pivotally secured to the movable handle.

An adjusting mechanism is provided for cooperation with said movable jaw, movable handle and for adjusting the position of the movable jaw relative to the stationary jaw. This adjusting mechanism consists of a threaded opening positioned within the receiving part of the fixed handle, and a screw member having a first end adapted for hand rotation thereof and a second end contacting the second end of the toggle member. The screw member has a plurality of multiple first individual threads with the same diameter and pitch throughout the entire length thereof.

BRIEF DESCRIPTION OF THE DRAWINGS

Other advantages and features of the invention are described with reference to exemplary embodiments, which are intended to explain and not to limit the invention, and are illustrated in the drawings in which.

DESCRIPTION OF THE PREFERRED EMBODIMENT

Although a specific embodiment of the invention will now be described with reference to the drawings, it should be understood that the embodiment shown is by way of example only and merely illustrative of but one of the many possible specific embodiments which can represent applications of the principles of the invention. Various changes and modifications, obvious to one skilled in the art to which the invention pertains, are deemed to be within the spirit, scope and contemplation of the invention as further defined in the appended claims.

Figure 1:
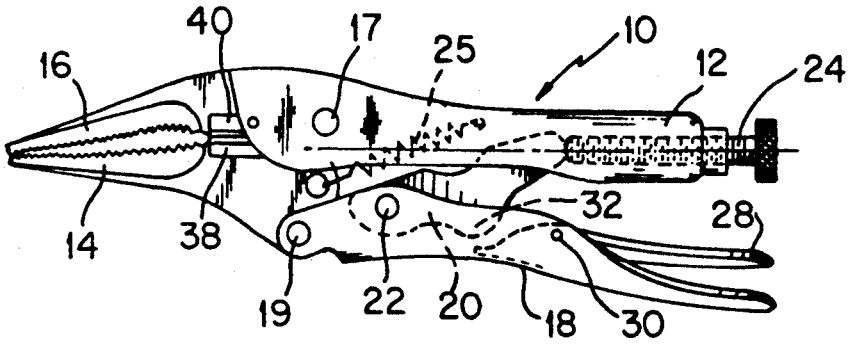
FIG. 1 is a side view of long-nose pliers utilizing the invention.

As best shown in FIG. 1, the long-nose locking pliers is generally designated by the reference numeral 10, and includes a handle member 12, and a movable clamping member or lower jaw 14. The handle member 12 is provided with a stationary clamping element or upper jaw 16. A toggle mechanism comprises an elongated handle member 18 and a toggle-link member 20 which is conventionally pivotally engaged at one end about the pin 22. The other free end (shown in phantom) of the toggle link member 20 is engaged with the handle member 12, and in particular the abutment end (also shown in phantom) of an adjustment screw member 24 which is suitably threadably engaged at the end of the handle member 12. Operation of the screw member will be discussed in full detail later in this application. The forward end of the handle member 18 is preferably bifurcated or forked, and a corner portion of the movable clamping member 14 is suitably disposed within the fork or between the bifurcation arms by pivot pin means 19. Similarly, the handle member 12 is preferably channel-shaped, and receives another corner portion of the movable clamping element 14 which is also suitably secured thereto by means of a pivot pin 17.

Spring means 25, preferably in the form of an extension coil spring, is secured between the handle member 12 and the movable clamping element 14 or lower jaw, to urge the clamping element 14 away from the stationary clamping element when the jaws are opened.

An elongated release lever 28 is suitably pivotally mounted by means of a pin 30, to the inside of the handle member 18, and is provided with a forwardly extending portion (as shown in phantom) and is engageable with a projection 32 of the toggle-like member 20 which extends toward the handle member 18. When the release lever 28 is pivoted about the pin 30, the handle member 12 is moved away from the handle member 18.

It will be appreciated that the wrench or locking pliers mechanism and toggle construction described herein, with some exceptions, conforms basically in accordance with the construction described in U.S. Pat. No. 1,489,458. Furthermore, such construction, the operation thereof, and the specific operation of the release lever is clearly set forth in U.S. Pat. No. 3,192,804. As explained in these Petersen prior art patents, closing of a locking wrench or pliers incorporating a toggle device is effected by moving the relatively movable handle member 18 toward the relatively fixed handle member 12. This movement forces the upper end of the toggle-like member 20 to move inwardly towards the handle member 12. The pivot pin 22 also moves inwardly, and when such pivot pin moves over center, the pliers is locked in a closed position.

Figure 2:
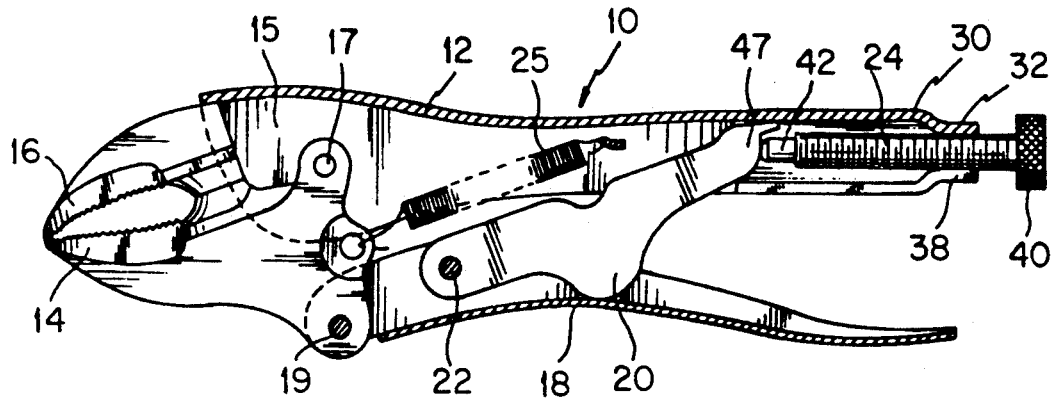
FIG. 2 is a side, partial cross-section view of pliers having curved jaws and utilizing the invention.

A tool of a further embodiment of the invention is best illustrated in FIG. 2 and includes a fixed arm 15 having a fixed handle 12 at one end and a fixed jaw 16 at the other end. A movable jaw 14 is pivotally attached to a movable handle member 18. The jaws 14 and 16, shown in FIG. 2, are curved and bulky. A toggle-link member 20 is pivotally engaged with the movable handle. The other free end 47 of the toggle-link engages with a contacting part of a screw member 24. The fixed handle is suitably formed as a U-shaped channel. The end of the fixed handle 30, remote from the fixed jaw 16, is completed with a receiving portion 32 having front 34 and rear 36 parts. A threaded opening 38 extends through the receiving portion from the part 34 to part 36. A screw member 24 is provided for threadable engagement with the threaded opening. The screw terminates in a knurled adjusting knob 40 at one end and the contacting part 42 at the other end.

When the screw member 24 is turned at the knob by the user, its rotation within the threaded opening results in advancement of the screw in the axial direction. Such advancement in the direction of the fixed jaw 16 presses the contacting part 42 against the toggle-link 20 and changes the distance between the end of the toggle link 47 from the pivot point 17 of the movable jaw 16, whereby the distance between the stationary jaw 16 and the movable jaw 14 is adjusted to grip objects of different dimensions without exerting excessive force.

Figure 3:
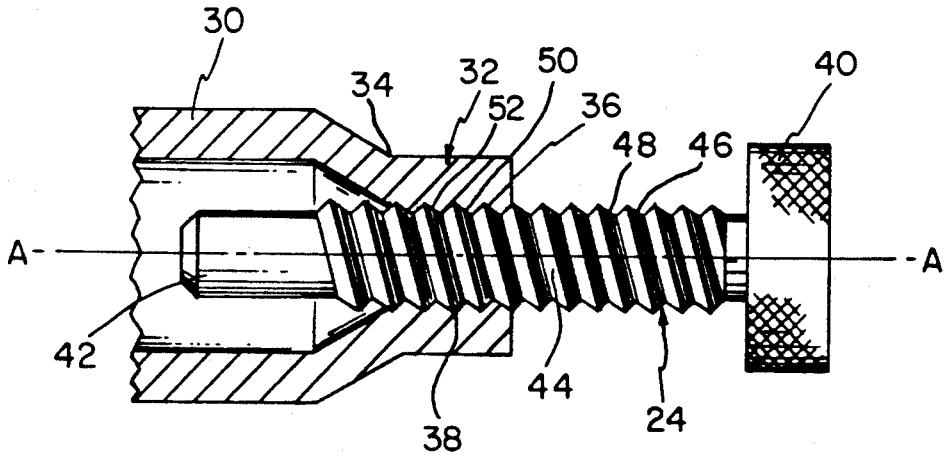
FIG. 3 is a partially, enlarged view of a threaded arrangement shown in FIGS. 1 and 2.

The screw member 24 and the threaded opening 38 are illustrated in better detail in FIG. 3. A combined threaded part 44 of the screw member consists of two individual, separate and coaxial threads 46 and 48 extending along a longitudinal axis A—A. However, the screw member having any reasonable number of individual threads is within the scope of the invention.

Figure 4:
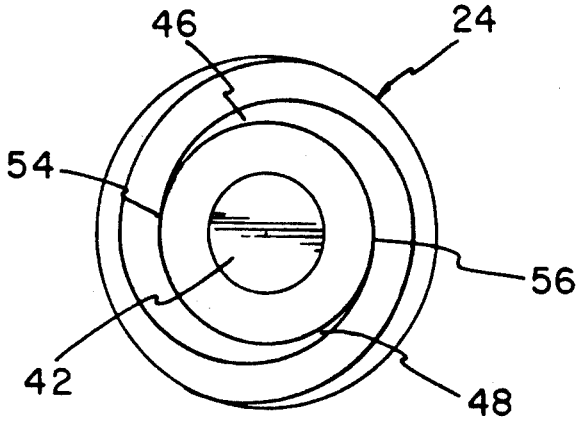
FIG. 4 is an end view of a screw member.
Figure 5:
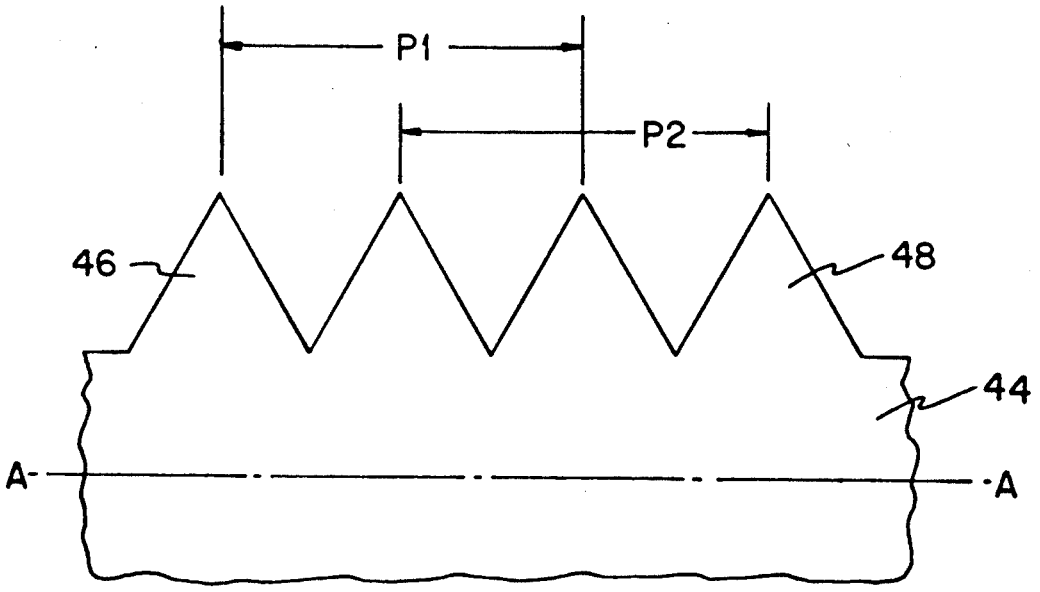
FIG. 5 is a partial cross-section view of threads of the screw member.

Since the pitches of the threads 46 and 48 shown in FIGS. 3–5 are identical, the distance between corresponding points on adjacent turns of the thread 46 is equal to the distance between corresponding points on adjacent turns of the thread 48.

FIG. 5 further illustrates that the crest and root diameters of both threads are essentially the same.

To provide adequate threadable engagement between the screw member 24 and the opening 38, the latter has a combined internal thread consisting of two individual, separate and coaxial threads 50 and 52 adapted to threadably engage with the threads 46 and 48 of the screw member. The internal individual threads 50 and 52 extend through the length of the opening 38 from the front part of the receiving portion 34 to the rear part 36.

In the preferred embodiment of the invention illustrated in FIG. 4, two different starting points 54 and 56, at a specific angle apart, are provided for the individual threads of the screw member. This is also applicable to the threaded opening. Although such angle between two starting points could be of any reasonable value, FIG. 4 illustrating an end view of the screw member of the preferred embodiment shows such angle equal 180°.

If the screw member is provided with three individual threads the angle between adjacent starting points could be 120°.

In order to prevent false starts when turning the screw member into the threaded opening, an alternative embodiment (not shown on the drawings) having a single initial or run-on turn is contemplated by the invention. Thus, one thread of the screw member makes initial mating engagement with the corresponding thread of the threaded opening at the beginning of the initial or run-on thread turn of the threaded engagement. Similarly, the second thread of the screw member makes initial mating engagement with the corresponding thread on the threaded opening at the beginning of the same initial or run-on turn. Therefore, only one starting point for two threads is provided in such alternative embodiment.

The threads of the invention could be metric as well as U.S. Standard threads.

When a single threaded engagement between the screw member and the threaded opening is used, as disclosed by the prior art, the distance which the screw advances axially on one turn of the knob is equal to the pitch of the single thread. On the contrary, if the multiple threaded screw is used, as provided by the invention, the axial advancement of the screw on one turn of the knob is equal to a combined pitch of all individual threads used. The screw member 24 has two individual threads 46 and 48 having corresponding pitches P1 and P2. When the user rotates the knob 40 one full turn, the advancement of the screw in the axial direction is equal to a combined pitch P1 and P2. Such double advancement by the screw acting on the toggle link substantially increases the rate of adjustment of the movable jaw relative to the stationary jaw.

Figure 6:
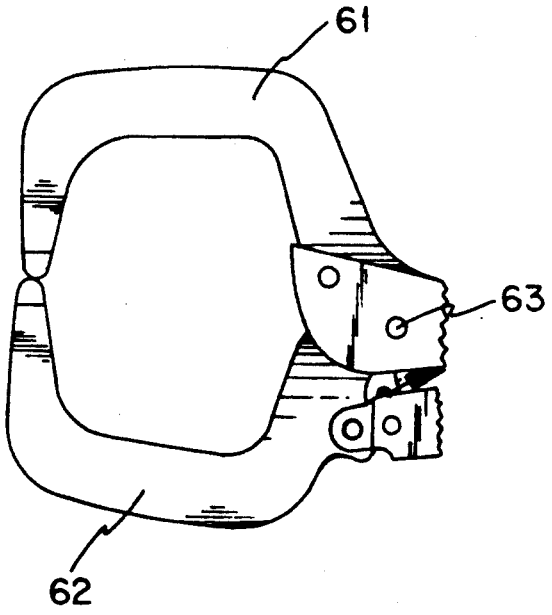
FIG. 6 shows a partial view of a toggle-locking C-clamp.

FIG. 6 illustrates the arms of a toggle-locking C-clamp wherein a fixed clamp member 61 is shown cooperating with a movable clamp member 62, which pivots about the pin 63.

Figure 7:
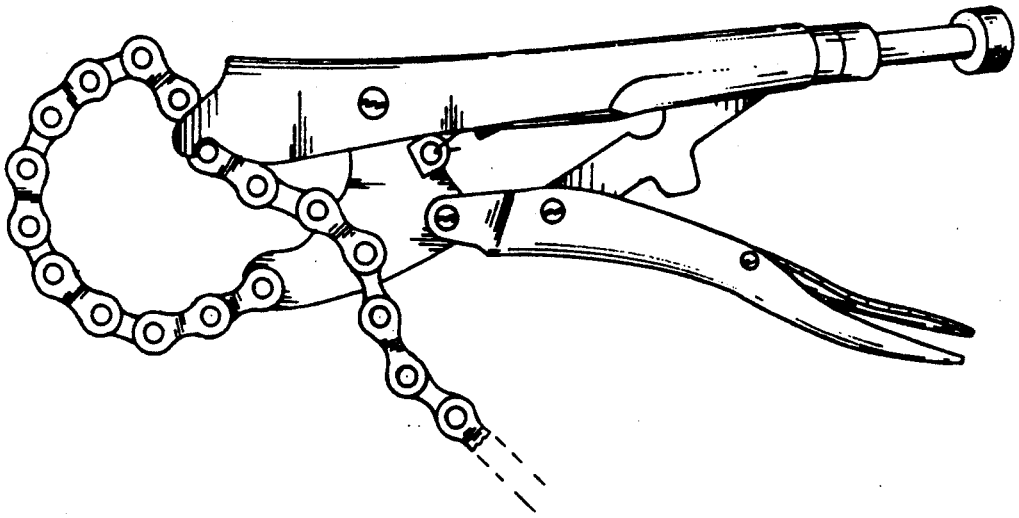
FIG. 7 is a perspective view of a locking chain clamp.
Figure 8:
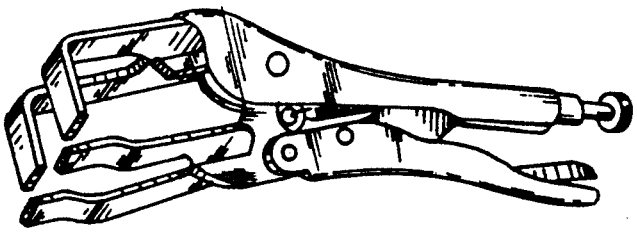
FIG. 8 is a perspective view of a locking welding clamp.
Figure 9:
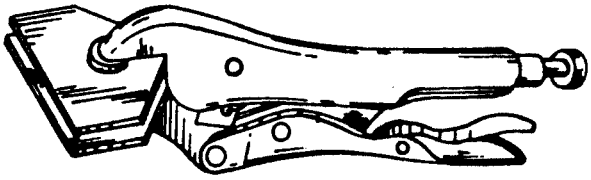
FIG. 9 is a perspective view of a sheet metal tool.

FIG. 7 shows a locking chain clamp, FIG. 8 shows a locking welding chain and FIG. 9 illustrates a conventional sheet metal tool. All tools are well-known in the art and are incorporated by reference.

The above-described arrangements for increasing the rate of adjustment of the movable jaws or similar movable part can be applied to the tools shown in FIGS. 6–9.

The adjustment screw arrangement described hereinabove is also applicable for Stilson wrenches, bench vises and other types of tools.

I claim:

1. A locking hand tool, comprising a fixed handle having front and rear portions, a fixed jaw connected to said front portion and a receiving part located at said rear portion;

a movable jaw pivotally connected to said front portion of said fixed handle for cooperation with said fixed jaw, and a movable handle connected to said movable jaw;

adjusting means for cooperation with said movable jaw, movable handle and for adjusting the position of the movable jaw relative to said fixed jaw, said adjusting means comprising a threaded opening in said receiving part of said fixed handle, and a screw member having a first end configured for hand rotation thereof, said screw member having a plurality of permanent first multiple individual threads with the same diameter and pitch throughout the entire length thereof;

said threaded opening having a plurality of permanent multiple second individual threads with the same diameter and pitch throughout the entire length thereof;

said plurality of first and second individual threads being of the same type and having identical pitches;

said plurality of said permanent second threads being engaged with said plurality of permanent first threads, whereby a substantially increased rate of advancement of said screw member in an axial direction resulting from rotational engagement of said plurality of first threads of the screw member with the plurality of second threads of the threaded opening, and the cooperation of said adjusting means with said movable handle and movable jaw produces a substantial increase in the rate of adjustment of said movable jaw relative to said stationary jaw.

2. The hand tool as claimed in claim 1, wherein said plurality of said first and second individual and separate threads of said screw member and said threaded opening are two of said first and two of said second threads.

3. The hand tool as claimed in claim 2, wherein said two first and two second threads have identical pitches.

4. The hand tool as claimed in claim 2, wherein said threads are U.S. standard threads.

5. The hand tool as claimed in claim 2, wherein said threads are metric standard threads.

6. The hand tool as claimed in claim 3, wherein one turn rotation of said screw within said threaded opening results in the advancement of the screw in the axial direction substantially equal to a combined pitch of said threads.

7. The hand tool as claimed in claim 2, wherein starting points of said threads on the screw and the threaded opening are positioned at an angle to each other.

8. The hand tool of claim 3, wherein said pitches are U.S. standard pitch 14.

9. The hand tool as claimed in claim 2, wherein each said thread is U.S. standard thread 5/16–18 UNC-2A.

10. The hand tool as claimed in claim 1, wherein said plurality of second individual and separated threads extend through the entire length of the threaded opening.

11. A locking hand tool, comprising:

a fixed handle with front and rear portions, a fixed jaw connected to said front portion and a receiving part located at said rear portion;

a movable jaw pivotally connected to said front portion of said fixed handle for cooperation with said fixed jaw, and a movable handle connected to said movable jaw;

toggle means defined by at least one toggle member having first and second ends, said first end of said toggle member being pivotally secured to said movable handle, adjusting means for adjusting the position of said movable jaw relative to said stationary jaw, and adjusting means comprising a threaded opening positioned within said receiving part of said fixed handle, and a screw member having a first end configured for hand rotation thereof and a second end in pressing contact with said second end of said toggle member, said screw member having a plurality of permanent multiple first individual threads with the same diameter and pitch throughout the entire length thereof;

said threaded opening having a plurality of permanent multiple second individual threads with the same diameter and pitch throughout the entire length thereof;

said plurality of first and second individual threads being of the same type and having identical pitches;

said plurality of said second threads being engaged with said plurality of first threads of said screw member, whereby a substantially increased rate of advancement of said screw member in an axial direction resulting from rotational engagement of said plurality of first threads of the screw member with said plurality of second threads of said threaded opening, and from the action of said adjusting means and said toggle member on said movable handle and movable jaw produces a substantial increase in the rate of adjustment of said movable jaw relative to said stationary jaw.

12. The hand tool as claimed in claim 11, wherein said plurality of said first and second individual and separate threads of said screw member and said threaded opening are two of said first and two of said second threads.

13. The hand tool as claimed in claim 12, wherein said two first and two second threads have identical pitches.

14. The hand tool as claimed in claim 13, wherein said threads are U.S. standard threads.

15. The hand tool as claimed in claim 12, wherein said threads are metric standard threads.

16. The hand tool as claimed in claim 13, wherein one turn rotation of said screw within said threaded opening results in the advancement of the screw in the axial direction substantially equal to a combined pitch of said threads.

17. The hand tool as claimed in claim 12, wherein starting points of said threads on the screw and the threaded opening are positioned at an angle to each other.

18. The hand tool as claimed in claim 13, wherein said pitches are U.S. Standard pitch 14.

19. The hand tool as claimed in claim 12, wherein each said thread is U.S. Standard thread 5/16–18 UNC-2A.

20. The hand tool as claimed in claim 11, wherein said plurality of second individual and separate threads extend through the entire length of the threaded opening.

* * * * *